United States Patent [19]

Yeh

[11] Patent Number: 4,813,250

[45] Date of Patent: Mar. 21, 1989

[54] LOCK DEVICE WITH CONCEALED MOUNTING SCREWS

[75] Inventor: Ching H. Yeh, Taiwan, Taiwan

[73] Assignee: Catwin Industrial Corp., Taiwan, Taiwan

[21] Appl. No.: 166,186

[22] Filed: Mar. 10, 1988

[51] Int. Cl.[4] ..... E05B 63/00

[52] U.S. Cl. ..... 70/104; 70/131; 70/451; 70/DIG. 57

[58] Field of Search ..... 70/127, 104, 131, 129, 70/451, 370, DIG. 57

[56] References Cited

U.S. PATENT DOCUMENTS 3,760,619 9/1973 Colombo ..... 70/104
4,297,862 11/1981 Solovieff ..... 70/129
4,584,856 4/1986 Petersdorff ..... 70/DIG. 57
4,640,112 2/1987 Kambie ..... 70/452

*Primary Examiner*—Robert L. Wolfe
*Attorney, Agent, or Firm*—Michael N. Meller

[57] ABSTRACT

A lock device is provided in which the locking bolt can be actuated by turning the outside lock cylinder or the thumbturn to releasably interlock the housing fixed to the inside surface of the door with a strike attached to the door frame. An inside lock cylinder is rotatably provided in the thumbturn and is designed to releasably lock the thumbturn. The lock device can not be dismounted from the inside of a room by an unauthorized person since all screws for mounting the housing are concealed within the housing, when the door is locked by the outside lock cylinder and the thumbturn is also locked with the inside lock cylinder.

4 Claims, 4 Drawing Sheets

LOCK DEVICE WITH CONCEALED MOUNTING SCREWS

FIELD OF THE INVENTION

This invention relates to a lock device, especially to a lock device which can not be dismounted from the inside of a room by an unauthorized person when the thumbturn is locked by the inside lock cylinder and the lock bolt is actuated by the outside lock cylinder to interlock the housing with the strike.

BACKGROUND OF THE INVENTION

Among known lock devices, there is one device which is so constructed that the locking bolt is only actuated by turning the lock cylinders or thumbturn to releasably interlock with the strike. Such a lock device is conventionally attached to the door by means of mounting screws. However, as the mounting screws are usually exposed on the outer surface of the housing of the lock, the lock may be easily dismounted by an unauthorized person who has entered the house through an entrance other than the door or by using a proper key. The unauthorized person may easily unscrew the mounting screws to dismount the lock and open the door, he can thus remove a large volume of valuable objects through the door.

In view of the above disadvantage, one object of this invention is to provide a lock device of the above mentioned type in which all the mounting screws are concealed within the housing of the lock device to prevent the latter from being dismounted by a person who has entered into the room unauthorized not through the door which is locked from the outside.

Another object of this invention is to provide a lock device with two lock cylinders and one thumbturn in which the inside lock cylinder is used to releasably lock the thumbturn instead of serving as a tool for actuating the locking bolt which is actuated by turning the outside lock cylinder or the thumbturn.

SUMMARY OF THE INVENTION

According to one aspect of this invention, there is provided a lock device which has an outside lock cylinder and a thumbturn both of which can be turned to actuate the locking bolt to interlock with the strike attached on the door frame. The lock device comprises a mounting plate which is affixed to the inside surface of the door by mounting screws and is capable of being engaged with a cover plate attached to the rear of the housing of the device with an adjusting screw threadably engaged with a support fixedly provided on the mounting plate. When the lock assembly is placed onto the mounting plate, the adjusting screw with its head positioned between the end wall of the housing and a stop formed on the cover plate can be turned to move to cause its head pushing against the end wall of the housing or the stop such that the cover plate together with the housing is moved relative to the mounting plate to allow the cover plate to engage with or disengage from the mounting plate whereby the lock device is securely mounted on or dismounted off the door. When the outside lock cylinder is turned to lock the door, the lock device can not be dismounted from the inside of the room by an unauthorized person since all mounting screws are concealed within the housing and the movement of the adjusting screw moving in the direction for dismounting the lock device is prohibited by the actuating lever of the outside lock cylinder.

In another aspect of this invention the lock device includes an inside lock cylinder rotatably provided in the shaft portion of the thumbturn. The inside lock cylinder is so arranged that it may be turned to releasably lock the thumbturn to prevent the thumbturn from turning so the unauthorized person can not use the thumbturn to release the locking bolt.

BRIEF DESCRIPTION OF THE DRAWINGS

The present invention will hereunder be described in more detail with reference to the accompanying drawings in which.

DETAILED DESCRIPTION OF THE PREFERRED EMBODIMENT

Figure 2:
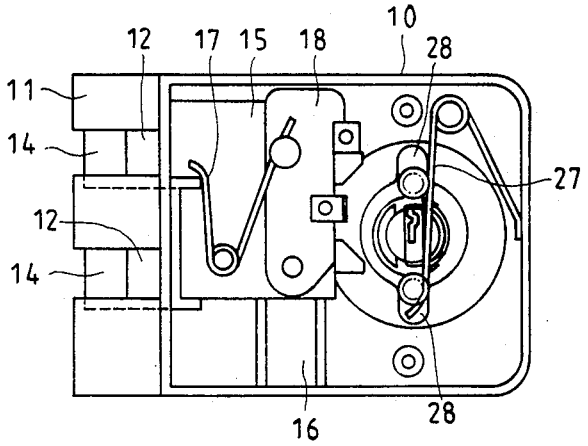
FIG. 2 is a plan view of the lock device of FIG. 1 viewing from the rear thereof, with the cover plate omitted showing its inner components.

Referring to FIGS. 1–4, the lock device of this invention includes a substantially rectangular housing 10 which is integrally formed at its one end with a protective casing 11 within which the locking bolts 14, 14 are vertically movably provided. Protective casing 11 has two slots 12, 12 adapted to engage with the looped portions 13, 13 (shown in imaginary lines) of the strike attached to door frame 60 when the door 50 is closed. Locking bolts 14, 14 are integrally formed at the end portion of locking member 15, which is allowed to move vertically along guide slot 16 and onto which swing plate 18, retained by torsion spring 17, is pivotally provided. Housing 10 has formed in its front portion a bore 19 into which thumbturn 21 is rotatably engaged. Hollow shaft portion 24 of thumbturn 21 is fixedly provided with a cam plate 28 retained and positioned by torsion spring 27. Also, the lock device has an outside lock cylinder (not shown) mounted in door 50. Actuating lever 35 of the outside lock cylinder extends into the slot formed on bushing 34 pivotally mounted on cover plate 30 which is detachably mounted on the back of housing 10. At the other end of bushing 34 a cam plate (not shown) having the same function as that of cam plate 28 is fixedly provided. Swing plate 18 and locking member 15 are so arranged that they may be actuated by the above mentioned cam plates 28 to cause locking member 15 to move along guide slot 16 in order to releasably interlock locking bolts 14, 14 with the strike when the outside lock cylinder or thumbturn 21 is turned. The above mentioned construction of this invention is smiliar to that of known lock devices of such types and a further explanation is omitted.

Figure 3:
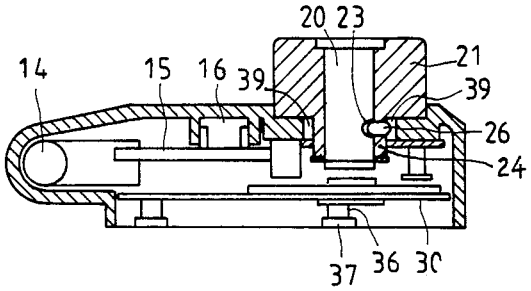
FIG. 3 is a cross sectional view of the lock device of FIG. 1.
Figure 1:
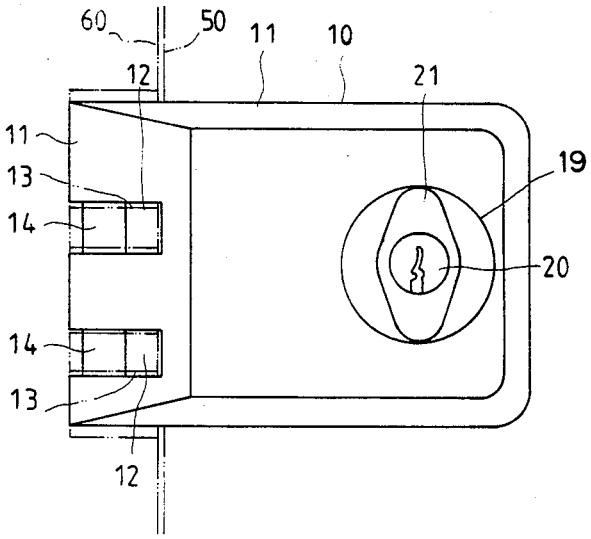
FIG. 1 is a diagramatic front view of an embodiment of the lock device according to this invention.
Figure 4:
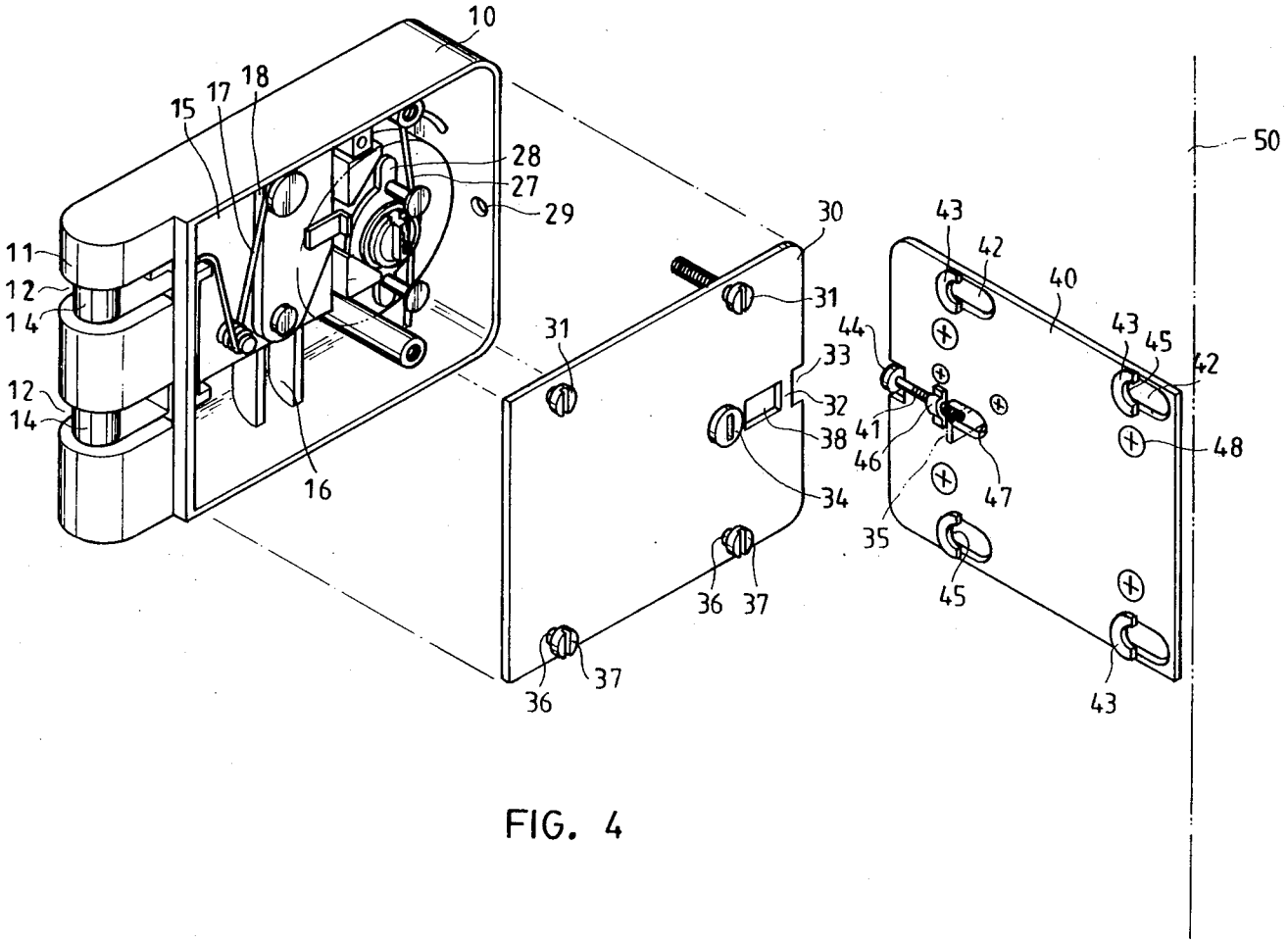
FIG. 4 is a perspective view of the lock device of FIG. 1 showing its cover plate and the mounting plate thereof.

As shown in FIGS. 3 and 5, according to this invention inside lock cylinder 20 is rotatably positioned within thumbturn 21 and is provided on its outer circumference surface with a semi-spherical recess 23 preferably located in a position perpendicular to the center line of key hole 22 of lock cylinder 20, and a through hole 25 is provided at hollow shaft portion 24 of thumbturn 21. Further, a pair of semi-spherical recesses 39, 39 diametrically opposed to each other is provided in the inner wall of bore 19 for pivotally mounting thumbturn 21, while locking pin 26 with round ends matching with semi-spherical recesses 23 or 39 is normally slidably engaged into the space confined by semi-spherical recess 23 and through hole 25 to allow turning thumbturn 21 to actuate locking bolts 14, 14. Locking pin 26 has a length slightly less than the sum of the radius of semi-spherical recess 23 or 39 and the wall thickness of shaft portion 24 such that it will be forced to move causing its two ends extending between through hole 25 and semi-spherical recesses 23 or 39 when thumbturn 21 or inside lock cylinder 20 is turned. More specifically, in FIGS. 5A and 5C inside lock cylinder 20 is in an unlocked state such that thumbturn 21 can be turned to actuate or release the locking bolts 14, 14; these two Figs. show respectively those cases in which the person inside the room may use thumbturn 21 to directly lock or unlock the door. With thumbturn 21 situated in a locked position as shown in FIG. 5A, inside lock cylinder 20 may be turned to a locked position with a matching key to "lock" thumbturn 21 to inhibit the latter from turning, as shown in FIG. 5B; in this connection an unauthorized person can not open the door without using a matching key. FIG. 5D shows the situation when after thumbturn 21 has been turned to release locking bolts 14, 14, inside lock cylinder 20 has also been turned to the locked position to lock thumbturn 21 to inhibit the latter from turning, thus locking the door through the outside lock cylinder with a proper key; in this case an unauthorized person is not only unable to open the door without a proper key but is also unable to dismount the lock device of this invention, which will be explained later.

Referring back to FIG. 4, according to this invention the lock device also includes a cover plate 30 detachably attached to the back of housing 10 and a mounting plate 40 fixed onto the inside surface of door 50 by means of fixing members such as machine screws 48. Cover plate 30 is located in such a position that the rear end surface of housing 10 will be flush with the inside surface of door 50 when the whole lock device is fitted onto mounting plate 40 with the latter completely concealed within housing 10. More specifically, cover plate 30 is provide on its rear surface with four engaging studs 31 and a notch 33 having a stop 32 formed near its one end. Each stud 31 has a small diameter portion 36 and a large diameter portion 37, and stop 32 has its one edge surface facing through hole 29 formed in the end wall of housing 10. Also, an opening 38 is provided between the above mentioned bushing 34 and stop 32 for receiving support 46 fixedly provided on mounting plate 40. A slot 47 is further provided in mounting plate 40 adjacent to support 46 to allow actuating lever 35 of the outside lock cylinder to extend therethrough and to extend into bushing 34. Adjusting screw 41 is threadably engaged into support 46 with its head portion 44 located between stop 32 of cover plate 30 and one end wall of housing 10 when the lock device is fitted onto mounting plate 40. It is to be noted that the diameter of hole 29 should be less than the diameter of head 44 of adjusting screw 41 to allow head 44 to press against the end wall of housing 10 when turning adjusting screw 41 with a screw driver to be inserted through hole 29 while attaching the lock device onto mounting plate 40. Mounting plate 40 is further provided with four elongated slots 42 with each slot 42 being so formed that large diameter portion 37 of stud 31 can be guided to move therein. At one end towards adjusting screw 41 each slot 42 is rounded and has fixedly provided thereon an engaging member 43 having integrally formed a semi-circular hole 45 to define underneath each engaging member 43 a space adapted to retain large diameter portion 37 of stud 31.

Figure 6B:
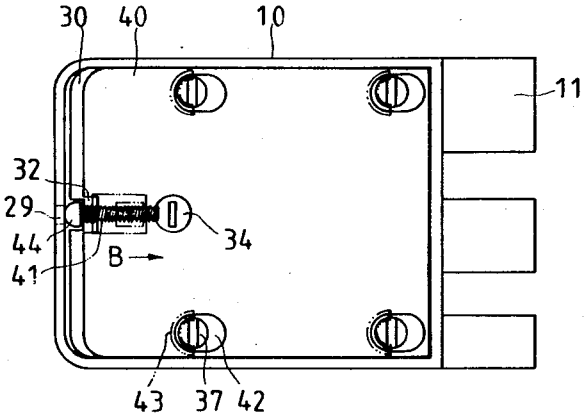
FIGS. 6A and 6B are diagramatic rear views of the lock device of FIG. 1 showing the movement of the adjusting screw during the assembly of the lock device on the mounting plate.
Figure 6A:
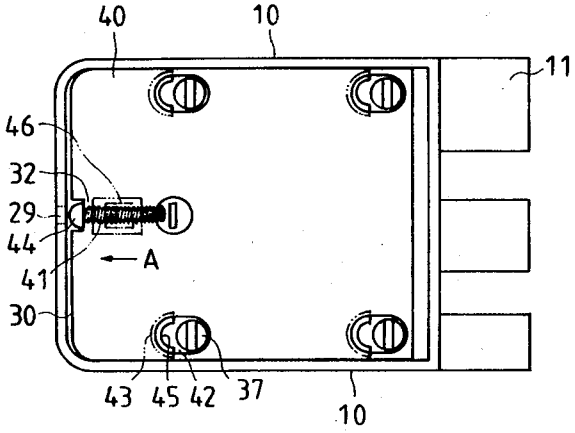
Figure 6C:
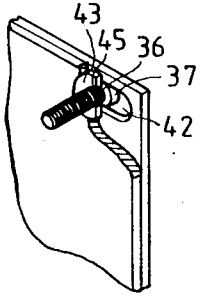
FIG. 6C is a partly cut away, partly sectioned perspective view showing the stud on cover plate engaged into the elongated slot of the mounting plate.

Now the operation of mounting and dismounting the lock device of this invention will be described as follows. In mounting this lock device, first fix the outside lock cylinder and mounting plate 40 respectively onto the outside surface and inside surface of door 50 with actuating lever 35 of the outside lock cylinder extending through slot 47 formed on plate 40; then place the lock device onto mounting plate 40 to allow actuating lever 35 to extend through bushing 34 and engage studs 31 into elongated slots 42. In such a state, as shown in FIG. 6A, head 44 of adjusting screw 41 is positioned between stop 32 of cover plate 30 and the end wall of housing 10, and the lock device will move relative to mounting plate 40 in the direction of arrow A when adjusting screw 41 is turned with a screw driver inserted through hole 29 in one direction causing its head 44 to push that end wall of housing 10 until each large diameter portion 37 of studs 31 is engaged underneath engaging member 43 with small diameter portion 36 abutting against the side surface of semi-circular hole 45 (as shown in FIG. 6C). As mounting screws 48 are all concealed within housing 10, the lock device of this invention is securely mounted.

The lock device can also be easily dismounted by the user as desired. As shown in FIG. 6B, with the lock device in an unlocked state, the lock device can be forced to move in the direction of arrow B when adjusting screw 41 is turned in the opposite direction causing its head 44 to press against stop 32 of cover plate 30 until stud 31 is disengaged from corresponding engaging member 43, thus dismounting the lock device from mounting plate 40.

Figure 5B:
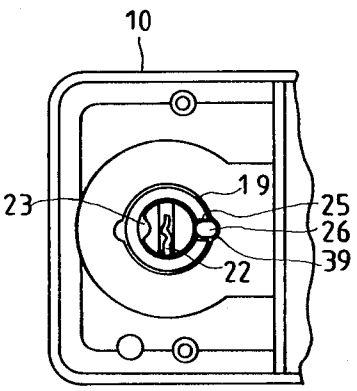
FIGS. 5A–5D are diagramatic views of the inner lock cylinder in various locked and unlocked states showing its usage.
Figure 5D:
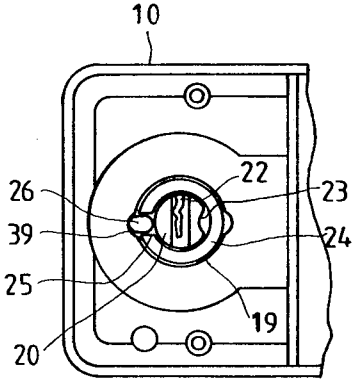
Figure 5A:
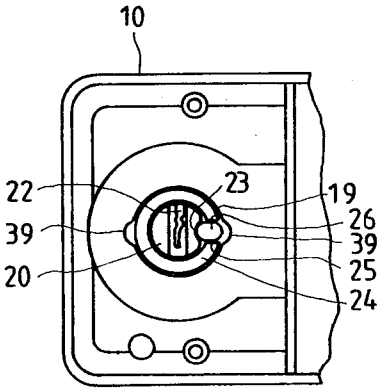
Figure 5C:
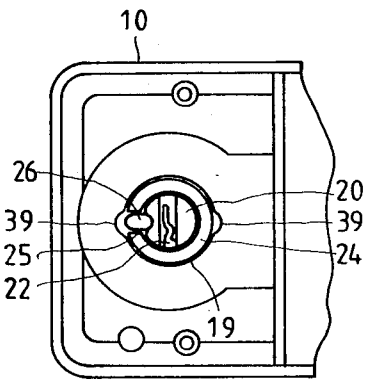
Figure 7:
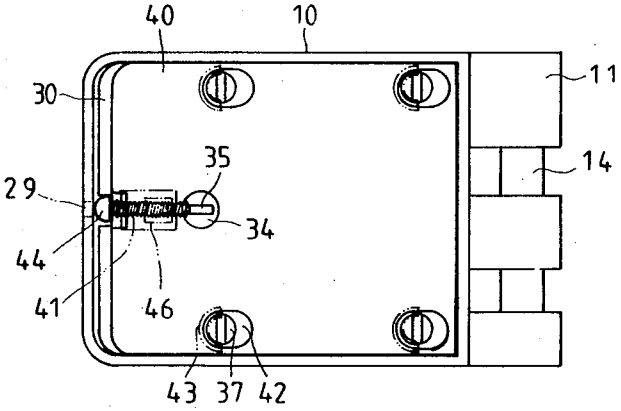
FIG. 7 is a diagramatic view showing the adjusting screw abutted against the actuating lever of the outside lock cylinder which is in a locked state.

To prevent the lock device from being dismounted by an unauthorized person, the user should keep the lock device in the state as explained with reference to FIG. 5D and actuate locking bolts 14 to interlock with strike 13 by means of the outside lock cylinder when he goes out. Then the lock device can not be dismounted by an unauthorized person inside the room even he tries to turn adjusting screw 41 because the movement of adjusting screw 41 will be prohibited by actuating lever 35 of the outside lock cylinder such that the lock device can not be moved to disengage it from mounting plate 40; as is clearly shown in FIG. 7. Accordingly, an unauthorized person will be prevented from going out through the door, and a large volume of valuable objects will also be prevented from being moved out through the door.

I claim:

1. A lock device for securing a door comprising:

a housing;

a strike attached to the door frame;

a locking member movably provided within said housing;

an outside lock cylinder;

a thumbturn rotatably provided into a circular hole formed on the front portion of said housing;

a mechanism operatively connecting said locking member and said outside lock cylinder and between said locking member and said thumbturn for actuating the locking bolts of said locking member to releasably interlock said housing with said strike;

a cover member being adapted to be detachably mounted at the open rear side of said housing and having a first engaging means provided thereon;

an inside lock cylinder rotatably provided into a shaft of said thumbturn including a restraint means for restraining the turning movement of said thumbturn;

a mounting member attached to the inside surface of said door having provided thereon a second engaging means adapted to engage with said first engaging means; and a screw means including an adjusting screw and a support member being fixedly attached to said mounting member and threadably engaged with said adjusting screw, the head of said adjusting screw being located between a side wall of said housing and a stop formed near one side of said cover member when said housing along with said cover member is placed onto said mounting member to cover said mounting member;

the arrangement being such that said housing together with said cover member will move relative to said mounting member to cause said first engaging means to engage with or disengage from said second engaging means when said adjusting screw is turned to move in a direction with the head thereof pressing against said side wall or said stop, thereby said housing is mounted on or dismounted from said mounting member.

2. A lock device according to claim 1, wherein said actuating mechanism includes an actuating lever operatively connected to said outside lock cylinder at one end, and the other end of said actuating lever extends through said mounting member and said cover member into said housing and is adapted to be actuated to a position, when said outside lock cylinder is turned to lock said locking bolts, in which the movement of said adjusting screw in one direction of causing said first engaging means to disengage from said second engaging means is stopped.

3. A lock device according to claim 1, wherein said first engaging means comprises a stud having a neck portion and a head portion of a dimension larger than the dimension of said neck portion, and said second engaging means comprises a slot being provided at one end thereof adjacent to said adjusting screw an engaging plate to define a space between the underside surface thereof and the inside surface of said door for retaining said head portion of said stud, said engaging plate having a recess mating with said neck portion.

4. A lock device according to claim 1, wherein said restraint means includes a pair of first semi-spherical recesses diametrically opposed to each other being formed at the inner wall of said circular hole for mounting said thumbturn, a second semi-spherical recess formed on the outer circumferential surface of said inner lock cylinder, a through hole formed on said shaft of said thumbturn, and a locking pin slidably provided into said through hole and said second semi-spherical recess and adapted to be caused to move with one end thereof engaging into a corresponding said first semi-spherical recess and the other round end thereof disengaging from said second semi-spherical recess to releasably lock said thumbturn.

* * * * *